US005864790A

United States Patent [19]

Leavy

[11] Patent Number: 5,864,790

[45] Date of Patent: Jan. 26, 1999

[54] METHOD FOR ENHANCING 3-D LOCALIZATION OF SPEECH

[75] Inventor: Mark Leavy, Beaverton, Oreg.

[73] Assignee: Intel Corporation, Santa Clara, Calif.

[21] Appl. No.: 826,016

[22] Filed: Mar. 26, 1997

[51] Int. Cl.[6] ..... G10L 9/18

[52] U.S. Cl. ..... 704/205; 704/226

[58] Field of Search ..... 704/205, 200, 704/260, 206, 214, 219, 233, 248, 226, 227, 228, 209, 207; 379/52; 381/94.3

[56] References Cited

U.S. PATENT DOCUMENTS

| | | | |
|---|---|---|---|
| 3,974,336 | 8/1976 | O'Brien | 704/226 |
| 4,099,030 | 7/1978 | Hirata | 704/203 |
| 4,622,692 | 11/1986 | Cole | 381/94.3 |
| 5,068,899 | 11/1991 | Ellis et al. | 704/212 |
| 5,083,310 | 1/1992 | Drory | 704/212 |
| 5,561,736 | 10/1996 | Moore et al. | 704/260 |
| 5,579,434 | 11/1996 | Kudo | 704/219 |
| 5,687,243 | 11/1997 | McLaughlin et al. | 381/94.3 |

*Primary Examiner*—Richemond Dorvil
*Attorney, Agent, or Firm*—Blakely, Sokoloff, Taylor & Zafman LLP

[57] ABSTRACT

A computer-readable medium stores sequences of instructions to be executed by a processor. These instructions cause the processor to perform the following steps to enhance 3-D localization of a speech source. A digital speech signal is received. The maximum frequency of the digital speech signal is determined. The sampling rate of the digital speech signal is increased. Next, wide-band Gaussian noise is added to the digital speech signal to create a wide-band digital speech signal with higher frequencies. Finally, the wide-band digital speech signal can be localized via an FIR (finite impulse response) filter.

22 Claims, 3 Drawing Sheets

METHOD FOR ENHANCING 3-D LOCALIZATION OF SPEECH

BACKGROUND

1. Field of the Invention

The present invention relates to speech processing. More specifically, the invention relates to a method and apparatus for enhancing 3-D (three-dimensional) localization of speech.

2. Description of Related Art

Normal human speech contains a wide range of frequency components, usually varying from about 100 Hz (hertz) to several KHz (kilohertz). For instance, human speech has a low frequency fundamental, but the harmonics of human speech has a fairly wide scale. Due to the wide range of frequencies found in human speech, one is able to localize a source of speech when one is speaking to someone. In other words, one is generally able to locate and identify the source of speech with a particular individual.

In order to determine the intelligibility or message of the speech, a listener does not require the higher-frequency components contained in the speech. Therefore, many communication systems, such as cellular phones, video phones and telephone systems that use speech compression algorithms, discard the high-frequency information found in a speech source. Thus, most of the high-frequency content above 4 kilohertz (KHz) is discarded. This solution is adequate when localization of the speech is not needed. But for applications that require or desire localization of the speech (e.g., virtual reality), the loss of the high-frequency components of the speech proves to be detrimental. This is because the higher-frequencies are required for speech localization by a listener. The high-frequency content in speech helps a listener to mentally perceive where a sound is located. For instance, it helps the listener determine whether a sound is located above or below the listener, or to the right or to the left, or in front of or in back of the listener. Thus, what is needed is a method of converting speech that has been transmitted through a communication system that discarded its high-frequency content. This method should allow a listener to localize the converted speech without losing any intelligibility in the speech.

SUMMARY

A computer-implemented method for enhanced 3-D (three-dimensional) localization of speech is disclosed. A speech signal that has been sampled at a predetermined rate per second is received. A maximum frequency for the speech signal is determined. The predetermined rate of sampling is increased. A low-level, wide-band noise is added to the speech signal to create a new speech signal with higher-frequency components.

BRIEF DESCRIPTION OF THE DRAWINGS

The present invention is illustrated by way of example and not a limitation in the figures of the accompanying drawings in which like references indicate similar elements.

DETAILED DESCRIPTION

A method and apparatus for enhanced 3-D (three-dimensional) localization of speech are described. In the following description, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

The present invention enhances 3-D localization of speech by providing high-frequency content to speech. This is required because the high-frequency content (e.g., higher than 4 KHz) of speech is often removed by speech compression algorithms during transmission. As a result, the high-frequency components in speech, which may be used for spatial localization cues, are lost. Consequently, the listener of compressed and localized speech is unable to accurately perceive the location of a speech source. Thus, the present invention corrects this problem by adding high-frequency, wide-band noise to the compressed speech after increasing its sampling rate and before performing localization.

Figure 1:
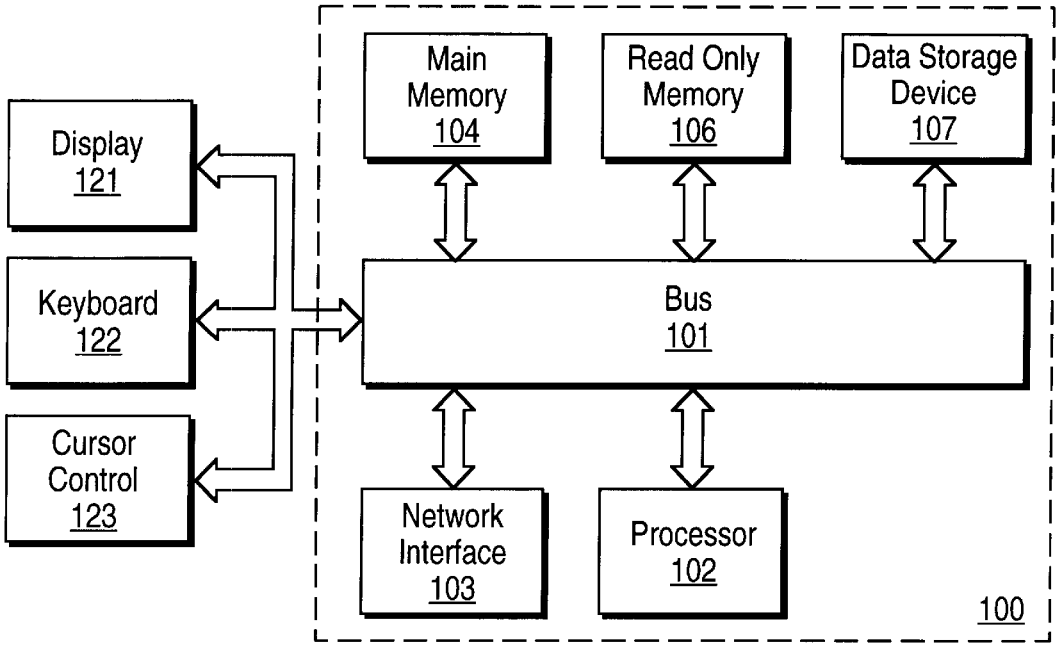
FIG. 1 illustrates an exemplary computer system in which the present invention may be implemented.

Referring to FIG. 1, an exemplary computer system upon which an embodiment of the present invention may be implemented is shown as 100. Computer system 100 comprises a bus or other communication device 101 that communicates information, and a processor 102 coupled to the bus 101 that processes information. System 100 further comprises a random access memory (RAM) or other dynamic storage device 104 (referred to as main memory), coupled to a bus 101 that stores information and instructions to be executed by processor 102. Main memory may also be used for storing temporary variables or other intermediate information during execution of instructions by processor 102.

Computer system 100 also comprises a read only memory (ROM) and/or other static storage devices 106 coupled to bus 101 that stores static information and instructions for processor 102. Data storage device 107 is coupled to bus 101 and stores information and instructions. A data storage device 107, such as a magnetic disk or an optical disk, and its corresponding disk drive, may be coupled to computer system 100. Network interface 103 is coupled to bus 101. Network interface 103 operates to connect computer system 100 to a network of computer systems (not shown).

Computer system 100 may also be coupled via bus 101 to a display device 101, such as a cathode ray tube (CRT), for displaying information to a computer user. An alpha numeric input device 122, including alphanumeric in other keys, is typically coupled to bus 101 for communicating information and command selections to processor 102. Another type of user input device is cursor control 123, such as a mask, a trackball, a cursor direction keys for communicating direction information and command selections to processor 102 and for controlling cursor movement on display 121. This input device typically has two degrees of freedom and two accesses, a first access (e.g., X) and a second access (e.g., Y), which allows the device to specify positions in a plane.

Alternatively, other input devices such as a stylist or pen can be used to interact with the display. A displayed object on a computer screen can be selected by using a stylist or pen to touch the displayed object. The computer detects a selection by implementing a touch sensitive screen. For example, a system may also lack a keyboard such as 122 and all the interfaces are provided via the stylist as a writing instrument (like a pen) and the written text is interpreted using optical character recognition (OCR) techniques. In addition, compressed speech signals can also arrive at the computer via communication channels such as an Internet or local area network (LAN) connection.

Figure 2:
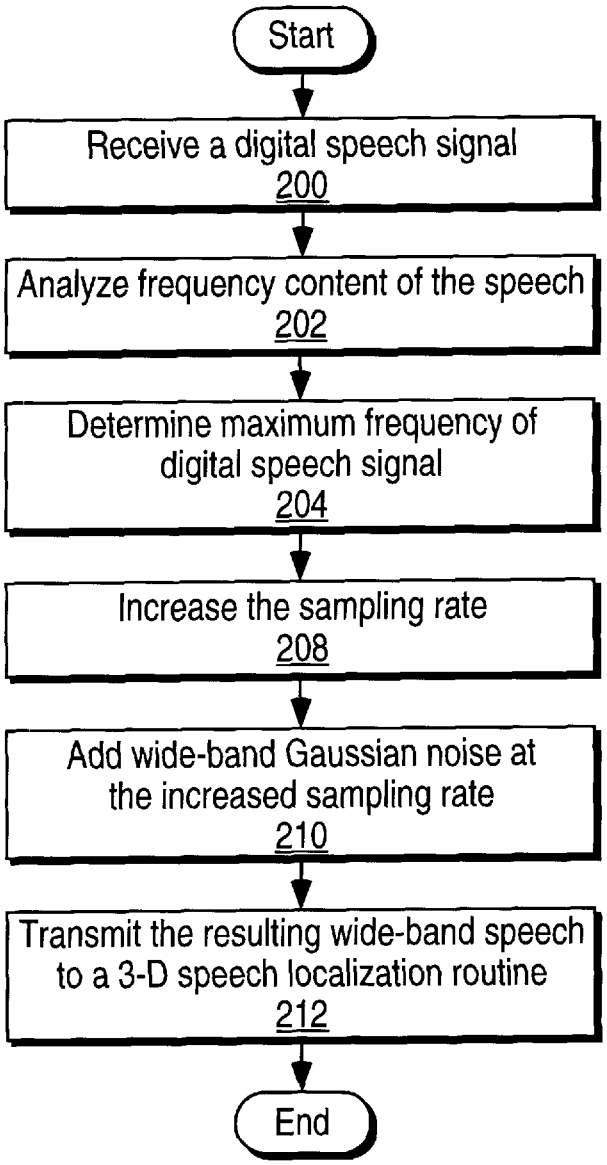
FIG. 2 is a flow chart illustrating one embodiment of the present invention.

FIG. 2 illustrates one embodiment of the present invention. In step 200, a digital speech source (signal) is received from a communication network. For example, possible digital speech sources are cellular phones, video phones and video-teleconferencing. In these systems, the high-frequency content (e.g., greater than 4 KHz) found in the speech is often discarded. This is because the high-frequency components of speech are not required for intelligibility of the speech. Furthermore, the high-frequency components of the speech are also discarded by speech compression algorithms.

In step 202, the frequency content of the received digital speech is analyzed. In step 204, the maximum frequency of the digital speech signal is calculated from the sampling rate of the received signal according to Nyquist's Law. In other words, the sampling rate of a signal is assumed to be twice the maximum frequency of the transmitted signal. For example, if the sampling rate of the digital speech source is 8 kilohertz (KHz), then the maximum frequency is equal to half of (8 KHz), which is 4 KHz. Thus, the maximum frequency of the transmitted signal is 4,000 Hertz.

At this point, the high-frequency content of the speech has already been removed (e.g., by a speech compression algorithm) and may not be used to provide directionality via spatial cues. More high-frequency information must be added to the speech to enhance 3-D localization. This is accomplished by first resampling the speech at a higher rate. In step 208, the sampling rate (e.g., 8 KHz) is increased, typically by a factor of two-to-six over the initial sampling rate. In one embodiment, the sampling rate can be increased from 8 KHz to a value ranging between 16 KHz to 48 KHz. In one embodiment, the sampling rate is increased from 8,000 times per second to 22,050 times per second (or about 22 KHz). A sampling rate of 22,050 times per second is the standard sampling rate for mid-range music and is similar to FM (Frequency Modulation) radio quality. For example, at 22 KHz, one hears more than just speech; one is also able to hear the tonal quality of instruments and sound-effects. Thus, the sampling rate is increased, but no additional high-frequency components are added.

In step 210, wide-band Gaussian noise is added to the speech signal with the increased sampling rate. Typically, the added wide-band Gaussian noise is at the Nyquist frequency corresponding to the increased sampling rate. For example, if the sampling rate was increased to 22 KHz or 22,050 times per second, then the wide-band Gaussian noise will also have a frequency band of 11025 hertz or half of the increased sampling rate. It will be appreciated that the Gaussian noise may have a different frequency than the increased sampling rate. It will also be appreciated that the wide-band Gaussian noise can have a frequency that is proportional to the increased sampling rate. In one embodiment, the added wide-band Gaussian noise can range from between about 8 KHz to about 24 KHz. The energy of the wide-band Gaussian noise is usually kept low enough so that it does not interfere with the intelligibility of the speech. As a result, the wide-band Gaussian noise that is added is approximately 20 to 30 decibels lower than the originally received digital speech signal.

The wide-band Gaussian noise adds high-frequency components to the original digital speech source. This is important for enhanced 3-D localization of the sound which may be introduced via a filter, for example, to recreate the speech source for a listener in a virtual-reality experience. In one embodiment, the resulting wide-band speech can be transmitted to a 3-D speech localization routine in a computer system in step 212. In addition, positional information regarding the digital speech source can be added at this time.

Positional information that corresponds to the speech source creates a more realistic virtual experience. For example, if one is in a multi-point video conference with five different people, whose pictures are each visible on a computer screen, then this positional information connects the speech with the appropriate person's picture on the display screen. For instance, if the person, whose picture is shown on the left-hand side of the screen, is speaking, then the speech source should sound like it is coming from the left-hand side of the screen. The speech should not be perceived by the listener as if it is coming from the person whose picture is on the right-hand side of the screen.

Another application for this invention is in a 3-D virtual-reality scene. For example, one is in a shared virtual-space or 3-D room where people are meeting and talking to a 3-D representation of each person. If the 3-D representation of a particular person is speaking audibly and not as text, the present invention should enable the receiver of the speech to connect the speech with the appropriate 3-D representation as the speech source. Thus, if a user were to walk from one group of speakers to another group, the speech received by the user should vary accordingly.

Figure 3:
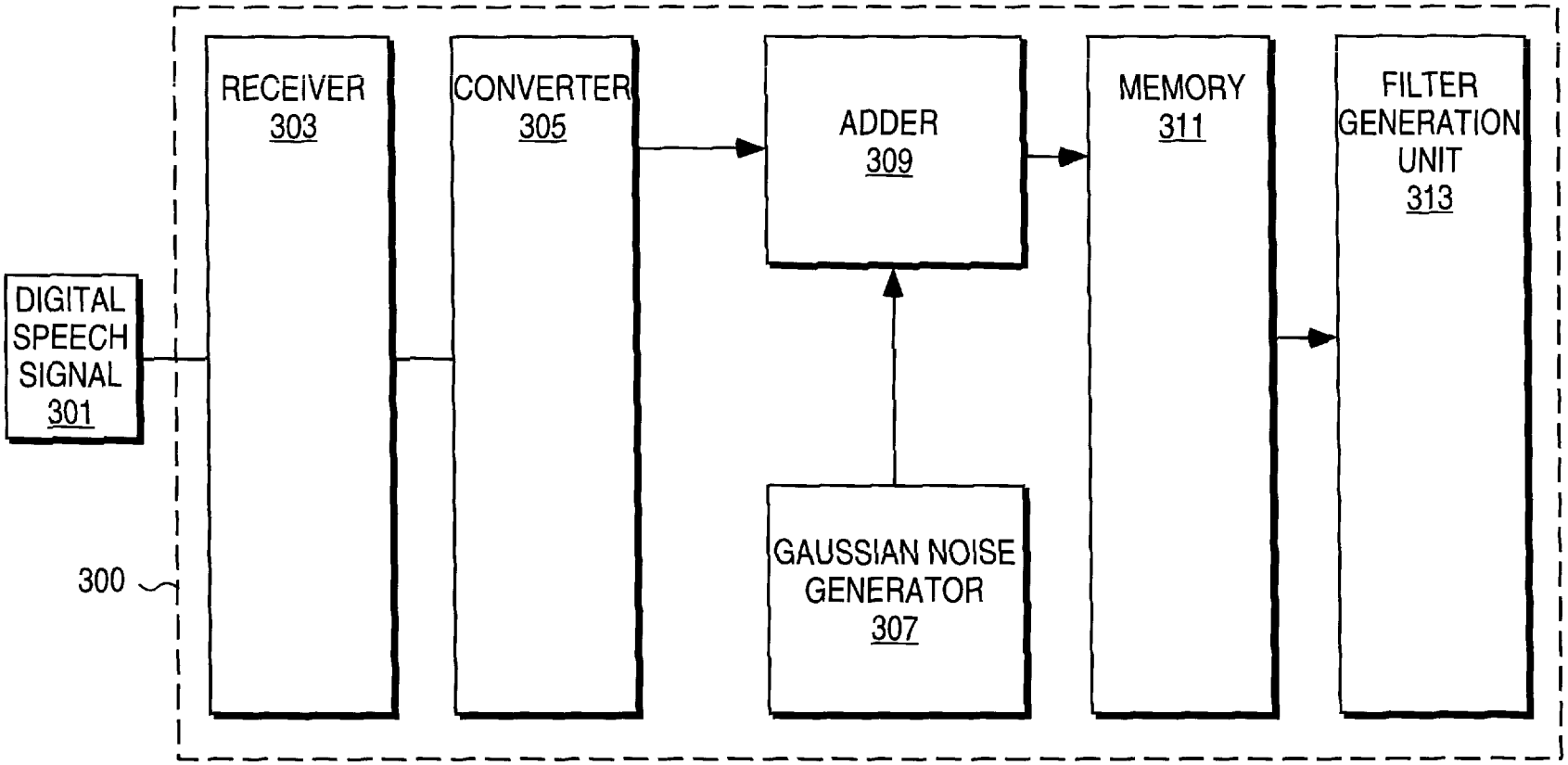
FIG. 3 illustrates one hardware embodiment that may be used in the present invention.

One hardware embodiment 300 of the present invention is illustrated in FIG. 3. A digital speech signal 301 is received by a receiver 303. The digital speech signal 301 is transmitted from a communication network, such as a cellular phone. Often human speech is first received as an analog signal that is then converted to a digital speech signal. This digital speech signal 301 is often compressed or band-limited before it reaches the receiver 303. Thus, high-frequency components (e.g., greater than 4 KHz) of the digital speech signal 301 are often removed.

The receiver 303 also determines the maximum frequency of the received digital speech signal. In one embodiment, the receiver 303 utilizes Nyquist's Law to determine the maximum frequency of the digital speech signal according to the digital sampling rate. For example, if the sampling rate is 6 KHz, then the maximum frequency according to Nyquist's Law is 3 KHz, which is half of the sampling rate. The converter 305 then converts or increases this minimum sampling rate to an increased sampling rate. The increased sampling rate can be, in one embodiment, two-to-six times greater than the previous sampling rate.

A generator 307 then creates wide-band Gaussian noise in order to increase the high-frequency content of the received digital speech signal 301. This is necessary because the high-frequency content of the speech enables a listener to better localize the digital speech. In other words, after 3-D localization, the high-frequency content of the speech enables a listener to determine if the speech source is located to the listener's right or left, or above or below the listener, or in front of or behind the listener. The 3-D localization of the speech enhances a listener's experience of the speech. The speech signal with the increased sampling rate and the wide-band Gaussian noise are combined in the adder 309. The resulting wide-band speech signal is then stored in a memory 311 before being transmitted, in one embodiment, to a filter generation unit 313. This filter may be a finite-impulse response (FIR) filter in one embodiment. It is to be appreciated that other filters can be used. In the prior art, the digital speech signal 301, without its high-frequency content (e.g., above 4 KHz) was often directly transmitted to the filter generation unit 313. As a result, the resulting digital speech often lacked perceptible 3-D localization cues. In sharp contrast, the present invention allows a listener to have enhanced 3-D localization capabilities or perception of a speech source. Thus, the listener enjoys a more realistic experience of the speech source.

In the above description, numerous specific details were given to be illustrative and not limiting of the present invention. It will be apparent to one skilled in the art that the invention may be practiced without these specific details. Furthermore, specific speech processing equipment and algorithms have not been set forth in detail in order not to unnecessarily obscure the present invention. Thus, the method and apparatus of the present invention is defined by the appended claims.

Thus, a method is described for enhancing 3-D localization of a speech source.

We claim:

1. A computer-implemented method for enhanced 3-D localization of speech, comprising:

receiving a digital speech signal that has been sampled at a predetermined rate;

determining a maximum frequency for the digital speech signal;

increasing the rate of sampling for the digital speech signal; and adding a low-level, wide-band noise to the digital speech signal to create a new digital speech signal with higher-frequency components.

2. The method of claim 1, further including the step of:

transmitting the new digital speech signal.

3. The method of claim 1, wherein the increased rate of sampling is at least twice the maximum frequency.

4. The method of claim 3, wherein the rate of sampling is increased by a factor that ranges between two-to-six.

5. The method of claim 1, wherein the low-level, wide-band noise has approximately half the frequency of the increased rate of sampling.

6. The method of claim 1, wherein the low-level, wide-band noise is approximately 20 to 30 decibels lower than the speech signal.

7. The method of claim 1, wherein the low-level, wide-band noise has a frequency in the range of about 8 KHz to about 24 KHz.

8. A computer-readable medium having stored thereon sequences of instructions, the sequences of instructions including instructions, which when executed by a processor, causes the processor to perform the steps of:

receiving a digital speech signal;

determining a maximum frequency that occurs in the digital speech signal;

determining a sampling rate for the digital speech signal;

increasing the sampling rate of the digital speech signal to an increased sampling rate;

adding a wide-band Gaussian noise to the digital speech signal to create a wide-band digital speech signal with higher frequencies; and transmitting the wide-band digital speech signal.

9. The computer-readable medium of claim 8, further including the step of:

providing positional information for the wide-band digital speech signal.

10. The computer-readable medium of claim 8, wherein the maximum frequency is about 4 kilohertz (KHz).

11. The computer-readable medium of claim 10, wherein the increased sampling rate is approximately between 16 to 48 KHz.

12. The computer-readable medium of claim 8, wherein the wide-band Gaussian noise has a frequency proportional to the increased sampling rate.

13. The computer-readable medium of claim 8, wherein the wide-band Gaussian noise has a frequency in the range of about 8 KHz to about 24 KHz.

14. The computer-readable medium of claim 8, wherein the wide-band Gaussian noise is approximately 20 to 30 decibels lower than the digital speech signal.

15. A programmable apparatus for enhancing 3D localization of speech, comprising:

a receiver for receiving a digital speech signal;

a converter, coupled to the receiver, for increasing the digital speech signal's sampling rate to an increased sampling rate;

a generator for generating a wide-band noise;

an adder, coupled to the converter and the generator, for combining the wide-band noise to the digital speech signal with the increased sampling rate to create a wide-band digital speech signal; and a memory coupled to the adder, wherein the memory stores the wide-band digital speech signal.

16. The programmable apparatus of claim 15, further including:

a filter, coupled to the memory, for localizing the wide-band digital speech signal.

17. The programmable apparatus of claim 15, wherein the digital speech signal has a frequency of about 4 KHz.

18. The programmable apparatus of claim 15, wherein the speech signal has a frequency of less than 4 KHz.

19. The programmable apparatus of claim 15, wherein the converter determines the digital speech signal's maximum frequency and then increases the digital speech signal's sampling rate by a factor of between two-to-six times over the maximum frequency.

20. The programmable apparatus of claim 19, wherein the wide-band noise has approximately half the bandwidth of the increased sampling rate.

21. The programmable apparatus of claim 15, wherein the wide-band noise is approximately 20 to 30 decibels lower than the digital speech signal.

22. The programmable apparatus of claim 21, wherein the wide-band noise has a frequency that is different from the frequency of the increased sampling rate.

* * * * *